United States Patent [19]

Briggs et al.

[11] 4,109,586

[45] Aug. 29, 1978

[54] UNIVERSALLY SUSPENDED SNUBBING RAILWAY AXLE TRUCK

[75] Inventors: Alan H. Briggs; Eric Timmons, both of Sheffield, England

[73] Assignee: British Steel Corporation, London, England

[21] Appl. No.: 770,047

[22] Filed: Feb. 18, 1977

[30] Foreign Application Priority Data

Feb. 20, 1976 [GB] United Kingdom ..... 6849/76

[51] Int. Cl.[2] ..... B61F 3/00; B61F 5/36; B61F 5/38; B61F 5/50

[52] U.S. Cl. ..... 105/224 A; 105/197 D; 105/222; 105/223; 267/3; 267/9 A

[58] Field of Search ..... 105/182 R, 197 R, 197 D, 105/197 DB, 224 R, 224 A, 222, 223; 267/3, 4, 9 A

[56] References Cited

U.S. PATENT DOCUMENTS

| | | | |
|---|---|---|---|
| 1,936,389 | 11/1933 | Hallquist | 267/4 X |
| 2,352,693 | 7/1944 | Davidson | 105/197 D |
| 2,626,572 | 1/1953 | Orr | 105/197 D |
| 2,720,848 | 10/1955 | Couch | 105/197 D X |
| 2,880,680 | 4/1959 | Quinn | 105/224 R |
| 2,963,987 | 12/1960 | Cottrell | 105/224 R |
| 3,286,653 | 11/1966 | Weber | 105/197 D X |
| 3,394,662 | 7/1968 | Weber | 105/197 D X |
| 3,517,620 | 6/1970 | Weber | 105/224 R X |
| 3,682,102 | 8/1972 | Pocklington et al. | 105/224 X |
| 3,841,233 | 10/1974 | Sinclair | 105/224 R |

FOREIGN PATENT DOCUMENTS

| | | | |
|---|---|---|---|
| 546,181 | 4/1956 | Belgium | 105/224 R |
| 1,056,000 | 1/1967 | United Kingdom | 105/224 R |
| 1,408,651 | 10/1975 | United Kingdom | 105/224 A |

*Primary Examiner*—Albert J. Makay
*Assistant Examiner*—Howard Beltran
*Attorney, Agent, or Firm*—Bacon & Thomas

[57] ABSTRACT

This invention provides a railway wagon suspension unit comprising a frame mounted over a saddle accommodating an axle journal housing. The saddle can rock laterally relative to the journal housing. Suspension means are disposed between the frame and the saddle including load springs for vertical support, and a friction wedge block is mounted on the saddle and firmly biassed against the axle journal housing to provide substantially constant frictional forces against lateral motion between the saddle and the housing independently of vertical movement or loading of the frame. In this manner lateral restraints imposed on wheel set oscillations during service are not load sensitive as has been the case with some wedge-pot dampers and other suspensions hitherto.

10 Claims, 3 Drawing Figures

UNIVERSALLY SUSPENDED SNUBBING RAILWAY AXLE TRUCK

This invention relates to railway wagon suspension units; such units may be used separately in conjunction with each wheel of a single axle two-wheel assembly, commonly called a pedestal unit, or embodied in side frames in a composite bogie structure, e.g. a four-wheel two-axle or six-wheel three-axle bogie.

From one aspect the present invention provides a railway wagon suspension unit comprising a frame mounted over a saddle accommodating an axle journal housing, suspension means disposed between the frame and the saddle including load springs for vertical support, and a friction block mounted on the saddle and firmly biassed against the axle journal housing to provide substantially constant frictional forces against lateral motion between the saddle and the housing.

Preferably the friction block is in the form of a wedge biassed against contact surfaces on both the saddle and the axle journal housing. Two blocks may be provided, one on each side of the housing. A vertical damper may be provided in parallel with the load springs, and the suspension means may also include a link (traction) rod or rods mounted between the frame and the saddle for stabilising the saddle against longitudinal forces generated in service and operable to transfer traction forces between the saddle and the frame and control axle movement in curves.

The provision of the constant friction block(s) in accordance with this invention ensures that lateral restraints imposed on wheel set oscillations during service are not load sensitive as has been the case with some wedge-pot dampers and other suspensions hitherto. The wear pattern on the wear plates is consequently determined only by the lateral movements and not both lateral and vertical motion. The incidence of jamming or sudden off-loading of the frame occasioned by the spring energy being constrained, or suddenly released, as a result of badly worn plates and wedge faces is therefore mitigated since the springs are relieved of any duties on friction damping.

In order that the invention may be fully understood, one embodiment thereof will now be described, by way of example, with reference to the accompanying drawings in which.

Figure 1:
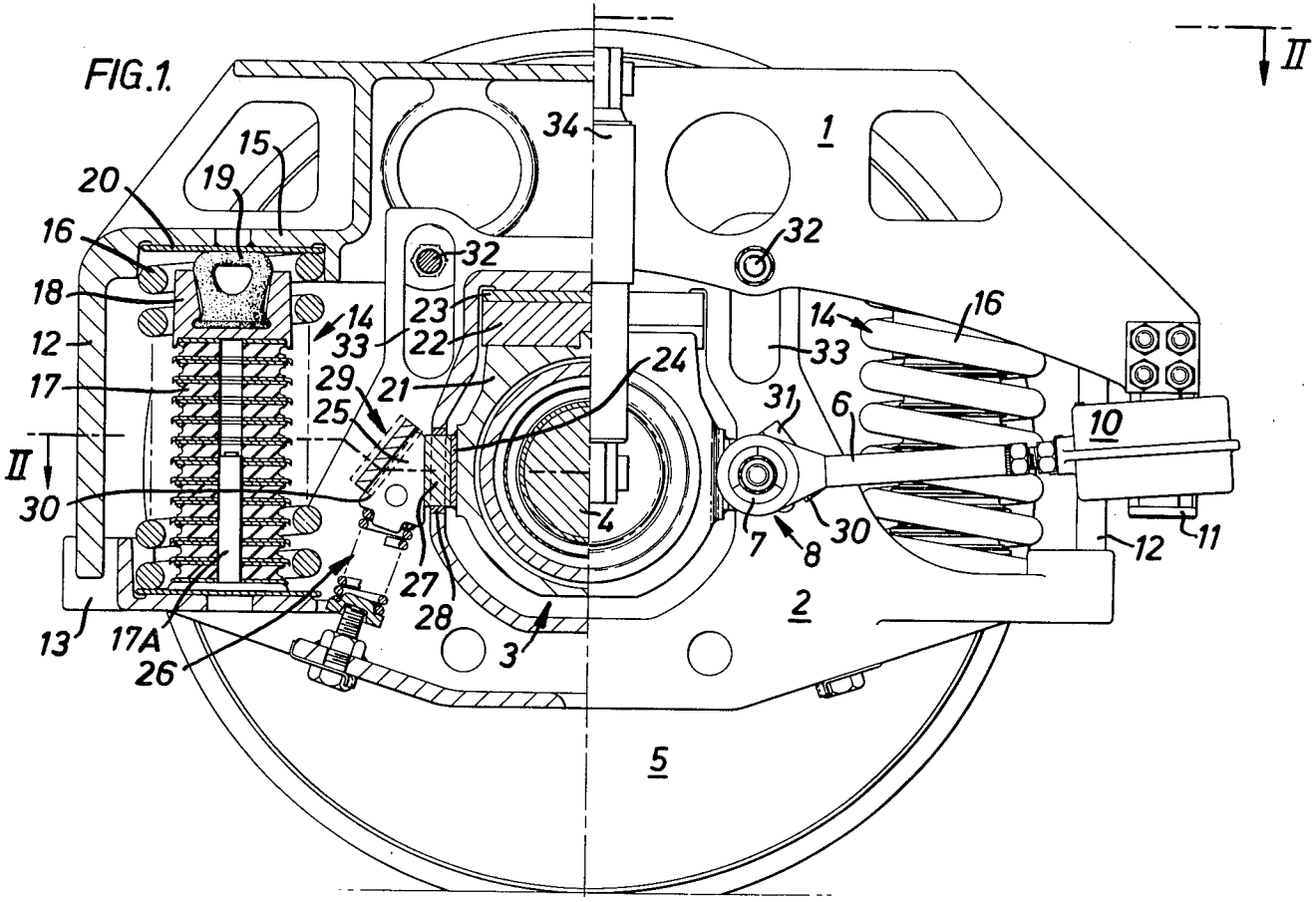
FIG. 1 is a part sectional side elevation of a suspension unit according to this invention.
Figure 2:
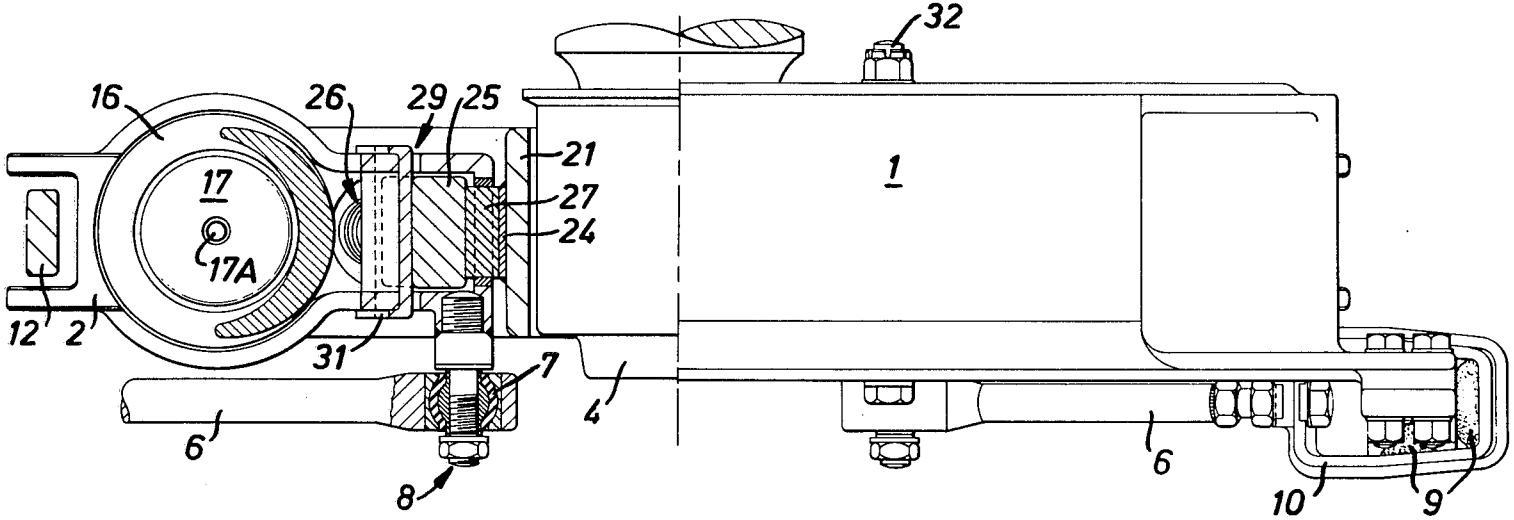
FIG. 2 is a section along II—II in FIG. 1.
Figure 3:
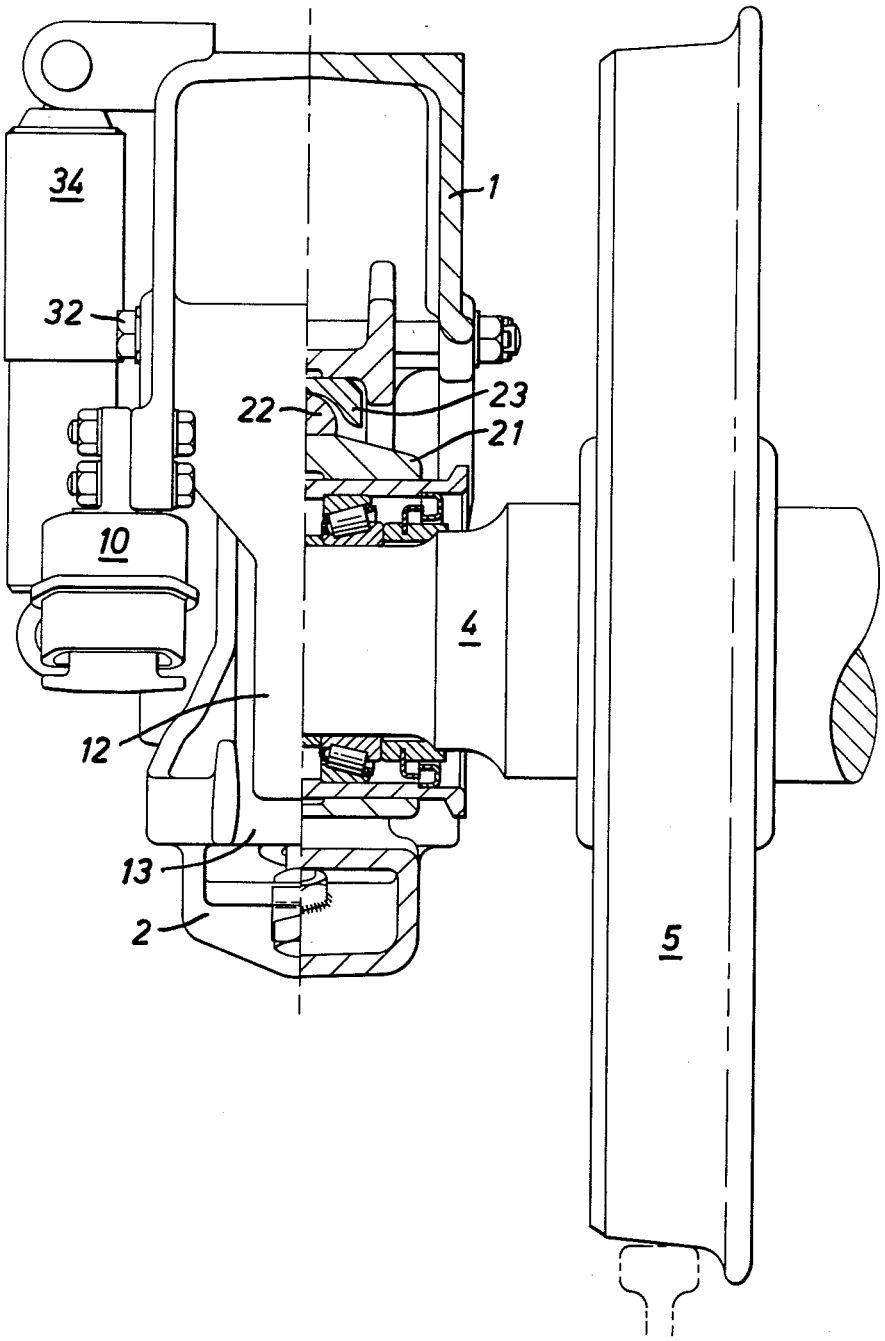
FIG. 3 is a part sectional end elevation of FIG. 1.

Referring now to the drawings a frame 1 is mounted over a saddle 2 which accommodates a journal housing 3 of an axle 4 on which is mounted a wheel 5 for relative movement between the saddle 2 and the journal housing 3. Two traction rods 6 extend inwardly from extremities of the frame to the saddle 2, the rods extending substantially horizontally and incorporating spherical rubber bearing bushes 7 (FIG.2) at their inner ends at which they are anchored by studs 8 and, at their outer ends, control rubbers 9 bonded to a cage 10 through which a Tee-shaped bar 11 extends. Control fingers 12 depend from the frame into slots 13 formed on the fore and aft platforms of the saddle to limit lateral movement between the frame and the saddle, and hence limit the lateral shear on the springs.

Spring sets 14 extend between the fore and aft platforms and aligned seatings 15 in the frame.

In particular each spring set comprises a coil spring 16 and mounted within it a series of bonded metal/rubber hollow discs 17 through the centre of which extends a hollow stabilising pillar 17A. The discs are surmounted by a cup 18 accommodating a hollowed rubber plug 19 which bears on the seating 15 via a disc 20. This spring set assembly provides variable rate springing with the plug 19 promoting a smooth transition between the rate of the coil spring and the composite spring rate.

The journal housing 3 incorporates an outer machined structure 21 having an elongated rib 22, convex in cross-section, secured to its upper surface. An inversely curved elongated channel member 23 mounted on the underside of the saddle aperture engages the rib, the saddle thus being borne on the structure 21 through this 'rocker' assembly which permits the saddle to rock laterally with respect to the axle journal housing.

Welded or otherwise secured to opposite sides of the structure 21 are two 'friction' wear or contact plates 24 which co-operate with associated constant friction blocks. More particularly, these blocks each comprise a cast steel wedge 25 mounted on saddle 2 and permanently biassed by a preset (i.e. exhibiting a predetermined constant force) spring unit 26 against the saddle structure itself on the one side and the axle journal housing on the other. Thus, the wedge block 25 moves laterally with saddle 2. Contact with the housing 21 is effected via an intermediate bearing member 27 which bears on the wear plate 24, this member, which is circular in cross-section, being housed within a bush 28 in the saddle wall. Contact with the saddle is effect via an elongated channelled member 29 which extends through aligned slots 30 in the saddle casting, being retained therein by lips 31 on the channel extremities; wear plates may be secured to this channelled member on which the wedge bears.

Retention bolts 32 extend through slots 33 in the saddle ensuring retention of the saddle within the frame should the latter be lifted.

Finally, a hydraulic damper 34 is mounted between the frame structure and the journal housing 3, that is, effectively in parallel with the load springs, so as to provide a degree of damping for the latter in the vertical sense. This facility overcomes problems associated with wheel loading suddenly being relieved in service by frictional forces, this being particularly significant should it occur over wheel weighing devices, which are now extensively used in the track, since false readings may otherwise be registered.

In operation, when the unit is in service the saddle principally effects vertical, longitudinal and lateral motion relative to the frame, the latter motion being manifested by the saddle 'rocking' about the rib/channel assembly — any tendency to rotational motion about the vertical axis is restrained by this assembly. The vertical motion is accommodated and damped primarily by the load springs, the longitudinal motion effected during driving and braking is accommodated and damped by the traction rods, relieving the load springs of shear forces which would otherwise be produced, and the lateral motion is restrained by the frictional forces between the wedge 25 and the members on which it bears, namely channel member 29 (directly) and wear plate 24 (indirectly).

The wedge provides a constant frictional force of predetermined intensity whatever the conditions of service, being governed only by the preset spring unit 26 — which is resilient simply to accommodate wear — and the wear pattern on the plates 24 is constrained to extend solely laterally.

Although the invention has been described with reference to the specific embodiment mentioned above, it is to be understood that various modifications may be made without departing from the scope of this invention. For example spring assemblies other than the built-up form illustrated at 17 may be used, e.g. a monolithic bonded metal/rubber unit. Other forms of wedge biassing may be used and indeed an alternative design by which a friction block bears directly on the axle journal housing could be utilised if there was sufficient room to accommodate such a structure in-line between the housing and the main spring set. The friction blocks may readily be made from bar instead of being cast as described.

The provision of two traction rods is also not essential; a single rod could be used, and other forms of bushing may be adopted at the rod ends.

We claim:

1. A railway wagon suspension unit comprising
a saddle
an axle journal housing accommodated in the saddle, the saddle being mounted for lateral rocking movement relative to the axle journal housing
a frame mounted over the saddle, the frame being vertically moveable relative to the saddle in response to vertical loads applied to the frame,
suspension means disposed between the frame and the saddle and including
load springs for vertical support, and
a friction block mounted on the saddle and firmly biassed against the axle journal housing whereby to provide substantially constant frictional forces against lateral motion between the saddle and the housing independently of vertical loading on the frame.

2. A suspension unit according to claim 1, wherein the block is in the form of a moveable wedge and including
a friction contact surface mounted on the saddle
the wedge being located between the friction contact surface on the saddle and the axle journal housing
biassing means for biassing the wedge to a preset degree against the said contact surface on the saddle and the axle journal housing.

3. A suspension unit according to claim 2, comprising
a moveable bearing member supported by the saddle between the wedge and the axle journal housing, the wedge being biassed against the axle journal housing via said moveable bearing member.

4. A suspension unit according to claim 3, wherein the saddle includes
platforms fore and aft of the axle journal housing and wherein the frame includes
seatings aligned with the fore and aft platforms, said load springs extending between the platforms and the aligned seatings, and further including, within the load springs,
a series of bonded metal/rubber hollow discs and
a resilient plug surmounting the discs bearing on the frame seating, whereby to provide variable rate springing with the plug providing a smooth transition between the rate of the coil spring and the composite spring rate.

5. A railway wagon suspension unit comprising
a saddle
an axle journal housing accommodatd in the saddle, the saddle being mounted for lateral rocking movement relative to the axle journal housing
a frame mounted over the saddle, the frame being vertically moveable relative to the saddle in response to vertical loads applied to the frame
suspension means disposed between the frame and the saddle and including, on opposite sides of the journal housing,
a pair of load springs for vertical support, and
a pair of friction wedges mounted on the saddle and firmly biassed against the axle journal housing whereby to provide substantially constant frictional forces against lateral motion between the saddle and the housing independently of vertical loading on the frame.

6. A suspension unit according to claim 5, comprising for each wedge
a friction contact surface mounted on the saddle
the wedge being located between the friction contact surface on the saddle and the axle journal housing
spring biassing means for biassing the associated wedge to a preset degree against the contact surface on the saddle and the axle journal housing.

7. A suspension unit according to claim 6, comprising stabilising traction rods connected to and extending substantially horizontally between the frame and the saddle on opposite sides of the journal housing.

8. A suspension unit according to claim 7, wherein the saddle includes
platforms fore and aft of the axle journal housing, and wherein the frame includes
seatings aligned with the fore and aft platforms, said load springs extending between the platforms and the aligned seatings, and further including, within each of the load springs,
a series of bonded metal/rubber hollow discs and
a resilient plug surmounting the discs bearing on the frame seating, whereby to provide variable rate springing with the plug providing a smooth transition between the rate of the coil spring and the composite spring rate, and
a vertical damper mounted between the frame and the journal housing in parallel with the load springs.

9. A railway wagon suspension unit comprising
a saddle
an axle journal housing accommodated in the saddle, the saddle being mounted for lateral rocking movement relative to the axle journal housing
a frame mounted over the saddle, the frame being vertically moveable relative to the saddle in response to vertical loads applied to the frame
suspension means disposed between the frame and the saddle and including, on opposite sides of the journal housing,
a pair of load spring means for vertical support,
a pair of friction wedges mounted on the saddle and firmly biassed against the axle journal housing whereby to provide substantially constant frictional forces against lateral motion between the saddle and the housing independently of vertical loading on the frame, and
a pair of stabilising traction rods mounted substantially horizontally between the frame and the saddle.

10. A suspension unit according to claim 9, comprising a channel member defining a channel of curved cross-section and a rib member nestling in the channel member and defining a rib of smaller radius of curvature than the channel with the rib engaging the channel, the saddle bearing on the journal housing through these engaging members whereby to permit lateral rocking motion of the saddle and housing relative to one another.

* * * * *